US010080411B2

(12) United States Patent
Deioma et al.

(10) Patent No.: US 10,080,411 B2
(45) Date of Patent: Sep. 25, 2018

(54) BACKPACK WITH AT LEAST ONE PARTITIONED, MULTI-ACCESS PORTION

(71) Applicant: Mudroom Backpacks LLC, Cotati, CA (US)

(72) Inventors: David M. Deioma, Cotati, CA (US); Brent Harris, Petaluma, CA (US)

(73) Assignee: Mudroom Backpacks LLC, Cotati, CA (US)

( * ) Notice: Subject to any disclaimer, the term of this patent is extended or adjusted under 35 U.S.C. 154(b) by 95 days.

(21) Appl. No.: 15/040,404

(22) Filed: Feb. 10, 2016

(65) Prior Publication Data

US 2016/0227908 A1 Aug. 11, 2016

Related U.S. Application Data

(60) Provisional application No. 62/114,181, filed on Feb. 10, 2015.

(51) Int. Cl.

| | |
|---|---|
| ***A45C 13/02*** | (2006.01) |
| ***A45C 13/10*** | (2006.01) |
| ***A45F 3/04*** | (2006.01) |

(52) U.S. Cl.

CPC ..... *A45C 13/02* (2013.01); *A45C 13/103* (2013.01); *A45F 3/04* (2013.01)

(58) Field of Classification Search

CPC . A45F 3/04; A45F 3/042; A45F 3/047; A45C 13/02; A45C 13/103

USPC ..... 224/627, 637–659, 681

See application file for complete search history.

(56) References Cited

U.S. PATENT DOCUMENTS

| | | | | |
|---|---|---|---|---|
| 2,464,350 | A * | 3/1949 | Schmidt | A45C 1/024 150/117 |
| 4,830,154 | A * | 5/1989 | Gerch | A45C 3/00 190/103 |
| 6,923,302 | B2 * | 8/2005 | Godshaw | A45C 13/00 190/109 |
| D640,868 | S * | 7/2011 | Jongchul | D3/279 |
| 8,453,813 | B2 * | 6/2013 | Lai | A45C 5/14 190/109 |
| 2002/0170935 | A1 * | 11/2002 | Annis | A45C 15/00 224/653 |
| 2004/0200871 | A1 * | 10/2004 | Han | A45C 13/36 224/576 |
| 2010/0108730 | A1 * | 5/2010 | Sabbah | A45F 3/04 224/651 |

(Continued)

*Primary Examiner* — Scott McNurlen

(74) *Attorney, Agent, or Firm* — Cooper Legal Group LLC; Ronald Kachmarik

(57) ABSTRACT

A backpack for carrying an item by a user includes a backpack body constructed of a flexible material. A first zipper fastener is on the backpack body and is actuatable between an opened position and a closed position. The backpack includes an accessory body constructed of a flexible material and positioned within an inner main cavity of the backpack body and borders an exterior of the backpack. The backpack includes a second zipper fastener on a first portion of the accessory body that borders the exterior of the backpack. The second zipper fastener is actuatable between an opened position and a closed position. The backpack includes a third zipper fastener on the second portion of the accessory body that borders the inner main cavity of the backpack body. The third zipper fastener is actuatable between an opened position and a closed position.

7 Claims, 6 Drawing Sheets

(56) References Cited

U.S. PATENT DOCUMENTS

| | | | | |
|---|---|---|---|---|
| 2010/0108731 | A1* | 5/2010 | Rowe | A45F 3/042<br>224/654 |
| 2011/0174584 | A1* | 7/2011 | Bedard | A45C 13/02<br>190/109 |

* cited by examiner

BACKPACK WITH AT LEAST ONE PARTITIONED, MULTI-ACCESS PORTION

CROSS REFERENCE TO RELATED APPLICATIONS

This application claims the benefit of U.S. Provisional Application No. 62/114,181, filed on Feb. 10, 2015, the entire disclosure of which is hereby incorporated herein by reference.

TECHNICAL FIELD

The present application relates to backpacks that are wearable by a user and are for carrying one or more items.

BACKGROUND

Backpacks are widely used by students, commuters, and others to store various items during travel. Often, the items to be stored can have different attributes (e.g., clean/dirty, wet/dry, etc.) and there may be interest to keep such items segregated. Also, there may be a desire to access items individually and/or access items from a primary access point.

Current backpack configurations do not provide for adequate address of such issues. Accordingly, there is a need for continued improvement within the backpack technologies. Indeed, there is a need for a backpack that allows for segregation of items into different compartments, such that items of one attribute (e.g., wet, dirty, etc.) may be segregated from items of a second attribute (e.g., clean, dry, etc.).

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a backpack for carrying an item by a user is provided. The backpack includes a backpack body constructed of a flexible material. The backpack body defines an inner main cavity. The backpack includes at least one shoulder strap coupled to the backpack body. The backpack includes a first zipper fastener on the backpack body. The first zipper fastener is configured to be actuatable between an opened position and a closed position. In the opened position, the inner main cavity of the backpack body is accessible from an exterior of the backpack body. In the closed position, the inner main cavity of the backpack body is substantially not accessible from the exterior of the backpack body. An accessory body is constructed of a flexible material and is positioned within the inner main cavity of the backpack body. The accessory body defines an ancillary cavity. A first portion of the accessory body borders the exterior of the backpack body. A second portion of the accessory body borders the inner main cavity of the backpack body. A second zipper fastener is located on the first portion of the accessory body. The second zipper fastener is actuatable between an opened position and a closed position. In the opened position, the ancillary cavity of the accessory body is accessible from the exterior of the backpack body. In the closed position, the ancillary cavity of the accessory body is substantially not accessible from the exterior of the backpack body. A third zipper fastener is located on the second portion of the accessory body. The third zipper fastener is actuatable between an opened position and a closed position. In the opened position, the ancillary cavity of the accessory body is accessible from the inner main cavity of the backpack body. In the closed position, the ancillary cavity of the accessory body is substantially not accessible from the inner main cavity of the backpack body.

In another example, a backpack for carrying an item by a user. The backpack includes a backpack body constructed of a flexible material. The backpack body defines an inner main cavity. The backpack body has a first side facing the user, a second side, opposite the first side, facing away from the user, a third lateral side extending between the first side and the second side, and a fourth lateral side extending between the first side and the second side. The third lateral side is spaced apart from the fourth lateral side and the first side is spaced apart from the second side to define the inner main cavity. At least one shoulder strap is coupled to the backpack body. A first zipper fastener is located on the backpack body. The first zipper fastener is configured to be actuatable between an opened position and a closed position. In the opened position, the inner main cavity of the backpack body is accessible from an exterior of the backpack body through the second side. In the closed position, the inner main cavity of the backpack body is substantially not accessible from the exterior of the backpack body through the second side. An accessory body is constructed of a flexible material and positioned within the inner main cavity of the backpack body. The accessory body defines an ancillary cavity. A first portion of the accessory body borders the exterior of the third lateral side of the backpack body. A second portion of the accessory body borders the inner main cavity of the backpack body. A second zipper fastener is located on the first portion of the accessory body. The second zipper fastener is actuatable between an opened position and a closed position. In the opened position, the ancillary cavity of the accessory body is accessible from the exterior of the backpack body through the third lateral side. In the closed position, the ancillary cavity of the accessory body is substantially not accessible from the exterior of the backpack body through the third lateral side. A third zipper fastener is located on the second portion of the accessory body. The third zipper fastener is actuatable between an opened position and a closed position. In the opened position, the ancillary cavity of the accessory body is accessible from the inner main cavity of the backpack body. In the closed position, the ancillary cavity of the accessory body is substantially not accessible from the inner main cavity of the backpack body.

In another example, a backpack for carrying an item by a user is provided. The backpack includes a backpack body constructed of a flexible material. The backpack body defines an inner main cavity. The backpack body has a first side facing the user, a second side, opposite the first side, facing away from the user, a third lateral side extending between the first side and the second side, and a fourth lateral side extending between the first side and the second side. The third lateral side is spaced apart from the fourth lateral side and the first side is spaced apart from the second side to define the inner main cavity. At least one shoulder strap is coupled to the backpack body. A first zipper fastener is located on the backpack body. The first zipper fastener is configured to be actuatable between an opened position and a closed position. In the opened position, the inner main cavity of the backpack body is accessible from an exterior of the backpack body through the second side. In the closed position, the inner main cavity of the backpack body is substantially not accessible from the exterior of the backpack body through the second side. An accessory body is constructed of a flexible material and positioned within the inner main cavity of the backpack body. The accessory body defines an ancillary cavity. A first portion of the accessory body borders the exterior of the third lateral side of the backpack body. A second portion of the accessory body borders the inner main cavity of the backpack body. A second zipper fastener is located on the first portion of the accessory body. The second zipper fastener is actuatable between an opened position and a closed position. In the opened position, the ancillary cavity of the accessory body is accessible from the exterior of the backpack body through the third lateral side. In the closed position, the ancillary cavity of the accessory body is substantially not accessible from the exterior of the backpack body through the third lateral side. A third zipper fastener is located on the second portion of the accessory body. The third zipper fastener is actuatable between an opened position and a closed position. In the opened position, the ancillary cavity of the accessory body is accessible from the inner main cavity of the backpack body. In the closed position, the ancillary cavity of the accessory body is substantially not accessible from the inner main cavity of the backpack body. A second accessory body is constructed of a flexible material and positioned within the inner main cavity of the backpack body. The second accessory body defines a second ancillary cavity. A first portion of the second accessory body borders the exterior of the fourth lateral side of the backpack body. A second portion of the second accessory body borders the inner main cavity of the backpack body. A fourth zipper fastener is located on the first portion of the second accessory body. The fourth zipper fastener is actuatable between an opened position and a closed position. In the opened position, the second ancillary cavity of the second accessory body is accessible from the exterior of the backpack body through the fourth lateral side. In the closed position, the second ancillary cavity of the second accessory body is substantially not accessible from the exterior of the backpack body through the fourth lateral side. A fifth zipper fastener is located on the second portion of the second accessory body. The fifth zipper fastener is actuatable between an opened position and a closed position. In the opened position, the second ancillary cavity of the accessory body is accessible from the inner main cavity of the backpack body. In the closed position, the ancillary cavity of the accessory body is substantially not accessible from the inner main cavity of the backpack body.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
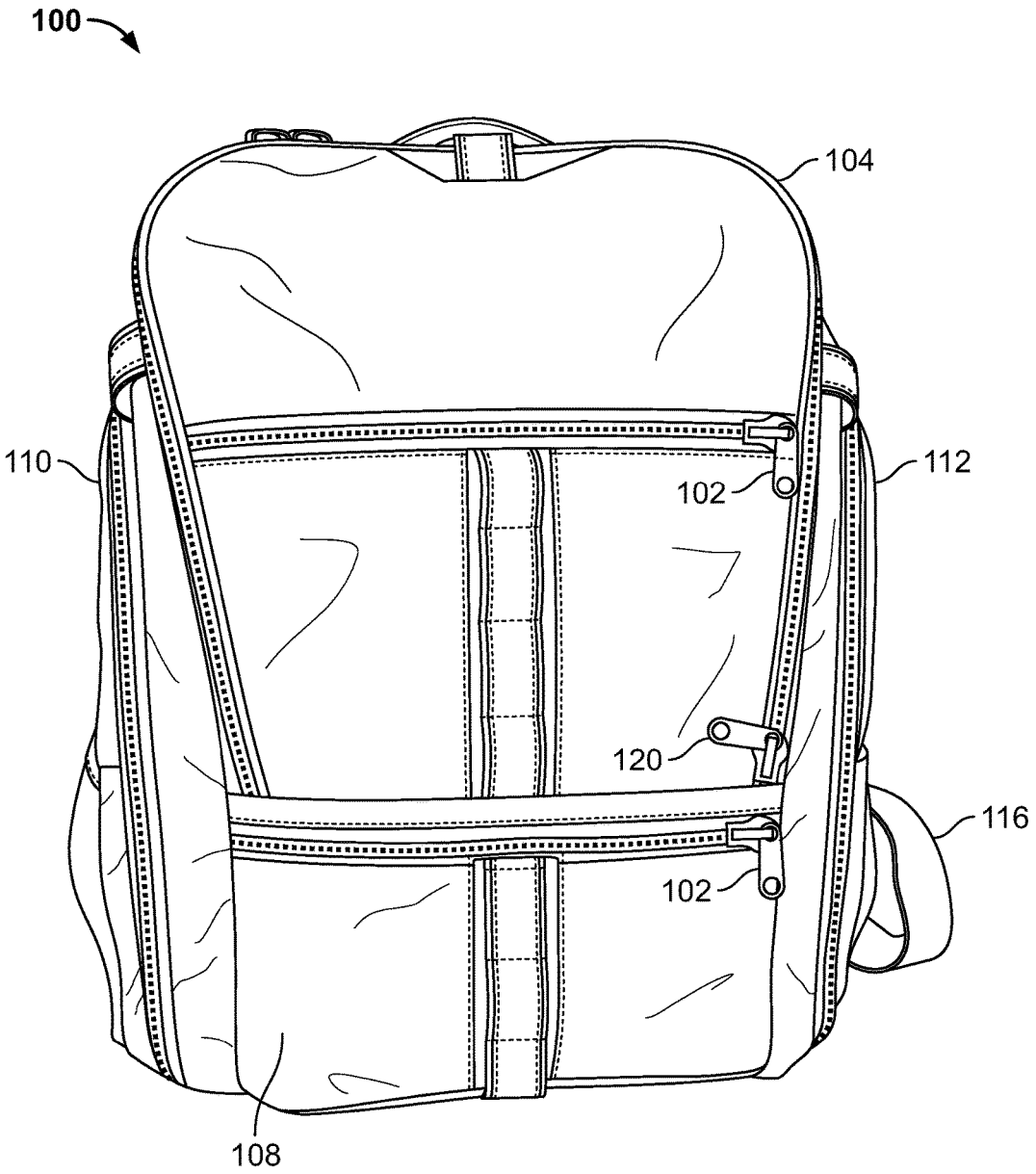
FIG. 1 is a perspective view of an example backpack.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter. Relative size, orientation, etc. of parts, structures, etc. may differ from that which is illustrated while not falling outside of the scope of the claimed subject matter.

Figure 2:
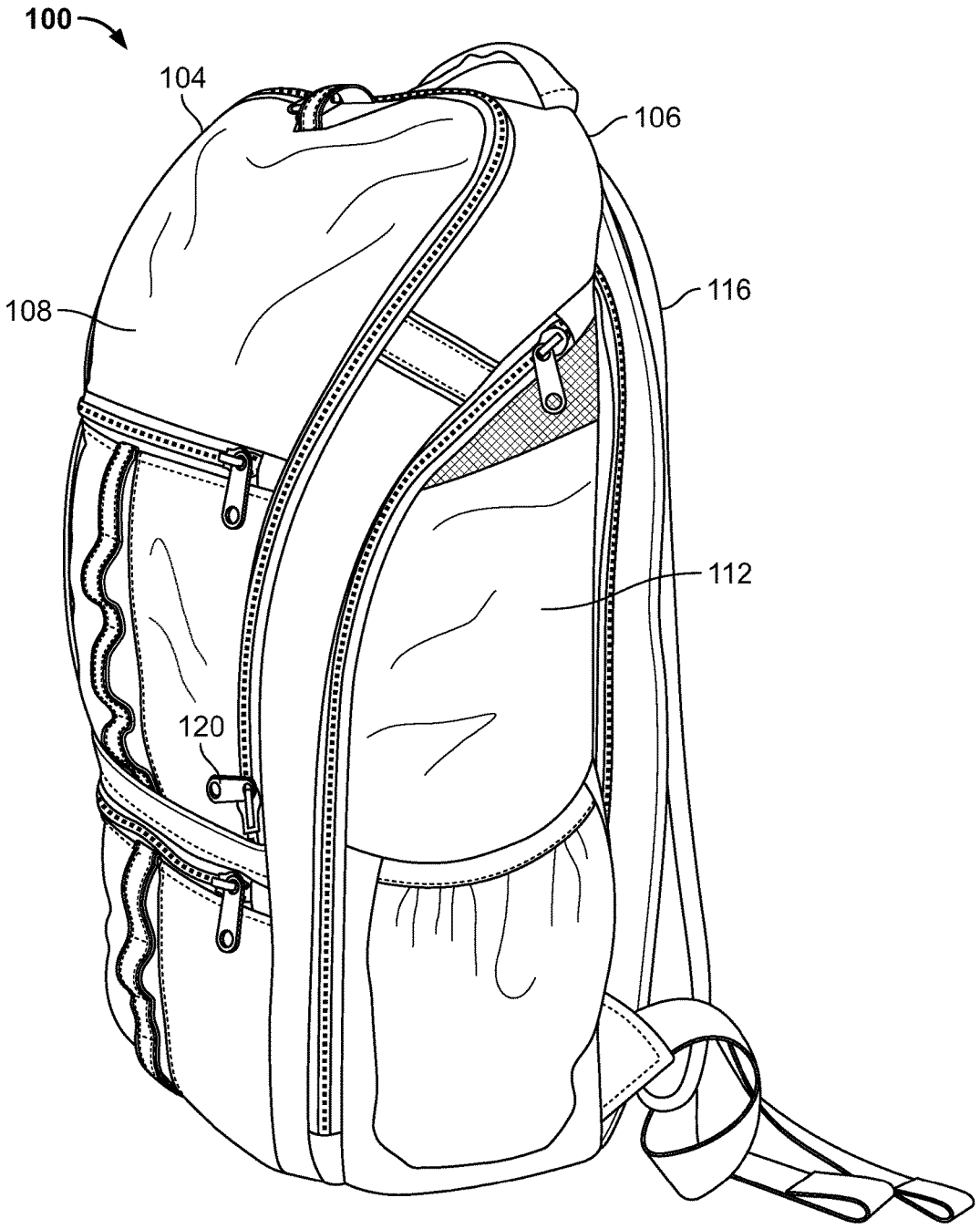
FIG. 2 is a perspective view of the example backpack.

Turning to FIGS. 1 and 2, a backpack 100 is illustrated. The backpack 100 can be used for carrying one or more items for a user. For example, the backpack 100 can be used to carry books, sporting goods, apparel, footwear, or the like. The backpack 100 may comprise one or more external fasteners 102 that define pockets, pouches, etc. into which items can be stored.

The backpack 100 includes a backpack body 104 constructed of a flexible material. In an example, the flexible material may include any number of flexible and pliable materials, such as nylon fabric or similar. The material may be treated or otherwise constructed to provide durability, wear resistance, weather/water proof ability, or the like. Although the backpack body 104 may be constructed primarily of a flexible material, it is to be appreciated that some portions of the backpack body 104 may be stiffened to provide a certain amount of rigidity and/or form/shape retention. In some examples, some portions of the backpack body 104 may be constructed to provide other attributes, such as waterproofing (e.g., such as provided by a rubberized bottom).

The backpack body 104 comprises a first side 106 (e.g., illustrated in FIG. 2), a second side 108 (e.g., illustrated in FIG. 2), a third lateral side 110 (e.g., illustrated in FIGS. 1 and 2), and a fourth lateral side 112 (e.g., illustrated in FIGS. 1 and 2). In an example, the first side 106 may face the user. The second side 108, opposite the first side 106, may face away from the user. The third lateral side 110 can extend between the first side 106 and the second side 108. The fourth lateral side 112 may likewise extend between the first side 106 and the second side 108. In an example, the first side 106 and the second side 108 may be spaced apart from each other. Likewise, in a possible example, the third lateral side 110 and the fourth lateral side 112 may be spaced apart from each other.

A shoulder strap 116 may be provided coupled to the backpack body 104. The shoulder strap 116 can allow for the user to carry the backpack 100. In an example, the backpack 100 may comprise two shoulder straps 116, though any number of shoulder straps 116 (e.g., one or more) may be provided. The shoulder straps 116 may include various structural attributes such as having adjustability structures, accessory clips, padding, and the like. In an example, the shoulder straps 116 may be attached to the backpack body 104 so as to provide a yolk that is centered near a base of a neck between the shoulder blades of the user. The shoulder straps 116 may also be attached to the backpack body 104 at or adjacent to a lower end portion corner of the backpack body 104. As such, these attachment portions may be near a waist or pelvic bone of the user. However, it will be appreciated that dimensions of the backpack body 104 may vary.

The backpack 100 comprises a first zipper fastener 120 on the backpack body 104. The first zipper fastener 120 is actuatable between an opened position and a closed position. By being actuatable, the first zipper zipper fastener 120 (or other zipper fasteners as disclosed herein) may be actuated (e.g., with a zipper slider movable with respect to a first side having a first row of teeth and a second side having a second row of teeth) between the opened position and the closed position. The first zipper fastener 120 may be constructed and attached to the backpack body 104 such that when the first zipper fastener 120 is in the opened position, access is permitted directly from an exterior of the backpack body 104 to an inner main cavity (illustrated in FIG. 3) of the backpack body 104. Within the shown example, the first zipper fastener 120 may comprise a zipper that extends in a substantially U-shaped configuration, with the U-shape being inverted so as to be upside down.

Figure 3:
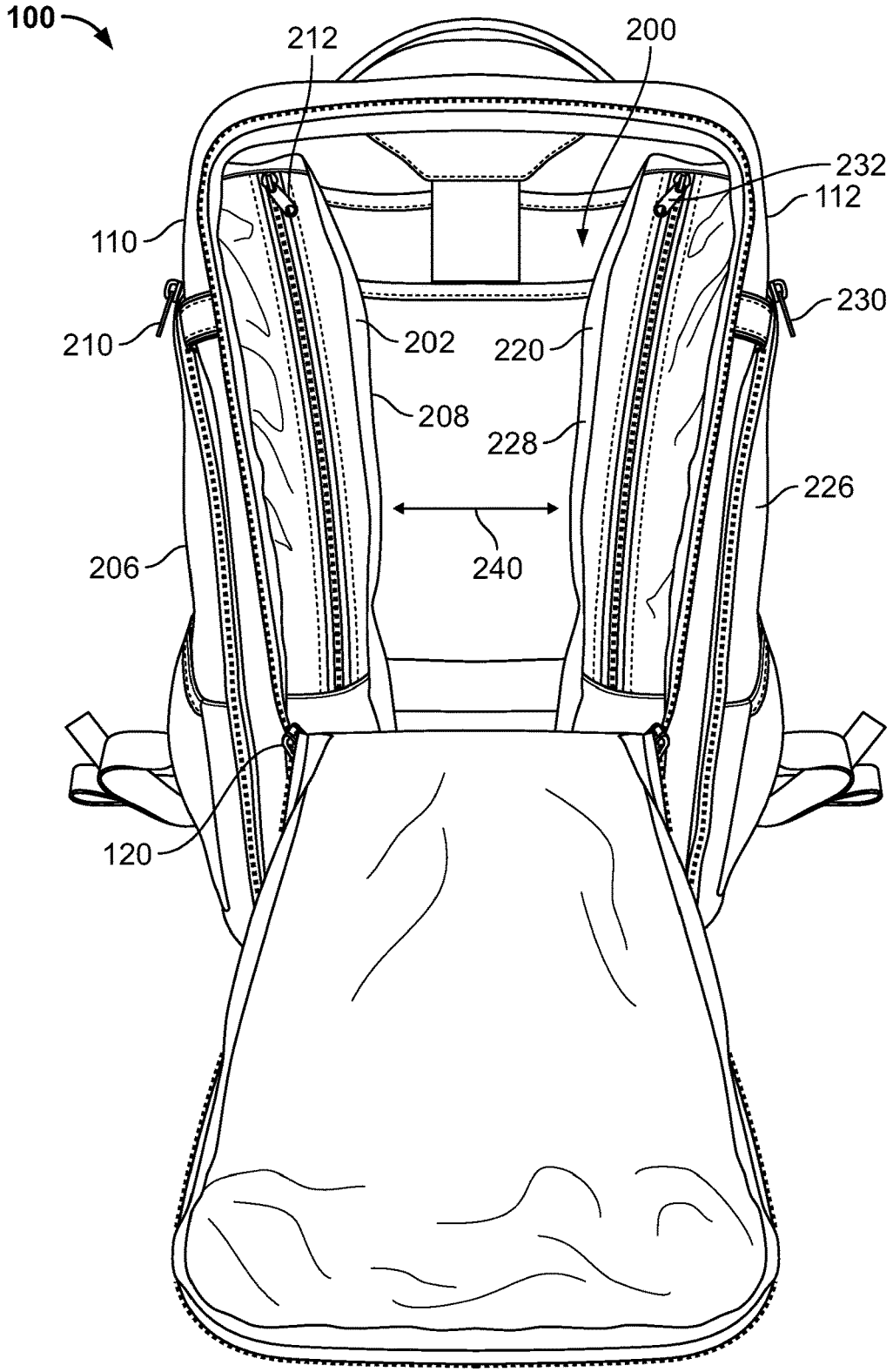
FIG. 3 is a perspective view of an inner main cavity of the backpack.

Turning to FIG. 3, the backpack body 104 can define an inner main cavity 200. In an example, the third lateral side 110 is spaced apart from the fourth lateral side 112, and the first side 106 is spaced apart from the second side 108 to define the inner main cavity 200. In an example, the inner main cavity 200 is sized to receive one or more items therein.

In the illustrated example, the backpack 100 is illustrated with the first zipper fastener 120 in the opened position. When the first zipper fastener 120 is in the opened position, the inner main cavity 200 of the backpack body 104 is accessible from the exterior of the backpack body 104 through the second side 108. When the first zipper fastener 120 is in the closed position, the inner main cavity 200 of the backpack body 104 is substantially not accessible from the exterior of the backpack body 104 through the second side 108.

The backpack 100 comprises an accessory body 202. The accessory body 202 may be constructed of a flexible material and positioned within the inner main cavity 200 of the backpack body 104. In an example, the flexible material may include any number of flexible and pliable materials, such as nylon fabric or similar. The material may be treated or otherwise constructed to provide durability, wear resistance, weather/water proof ability, or the like. Although the accessory body 202 may be constructed primarily of a flexible material, it is to be appreciated that some portions of the accessory body 202 may be stiffened to provide a certain amount of rigidity and/or form/shape retention. In some examples, some portions of the accessory body 202 may be constructed to provide other attributes, such as waterproofing.

The accessory body 202 comprises a first portion 206 and a second portion 208. The first portion 206 of the accessory body 202 may border the exterior of the backpack body 104. In the illustrated example, the first portion 206 of the accessory body 202 may be located at the third lateral side 110 of the backpack body 104.

In an example, a second zipper fastener 210 may be located on the first portion 206 of the accessory body 202. The second zipper fastener 210 is actuatable between an opened position and a closed position. The second zipper fastener 210 may be constructed and attached to the first portion 206 of the accessory body 202 such that when the second zipper fastener 210 is in the opened position, access is permitted directly from the exterior of the backpack body 104 to an ancillary cavity (illustrated in FIG. 5) of the accessory body 202. In the closed position, the ancillary cavity of the accessory body 202 is substantially not accessible from the exterior of the backpack body 104. In this example, the second zipper fastener 210 extends along a non-linear axis between a first end (e.g., a bottom end) and a second end (e.g., a top end).

In an example, the second portion 208 of the accessory body 202 may border the inner main cavity 200 of the backpack body 104. In the illustrated example, the second portion 208 of the accessory body 202 may be located within the backpack body 104, while the first portion 206 of the accessory body 202 may border an exterior of the backpack body 104.

In an example, a third zipper fastener 212 may be located on the second portion 208 of the accessory body 202. The third zipper fastener 212 is actuatable between an opened position and a closed position. The third zipper fastener 212 may be constructed and attached to the second portion 208 of the accessory body 202 such that when the third zipper fastener 212 is in the opened position, access is permitted directly from the inner main cavity 200 of the backpack body 104 to the ancillary cavity (illustrated in FIG. 5) of the accessory body 202. In the closed position, the ancillary cavity of the accessory body 202 is substantially not accessible from the inner main cavity 200 of the backpack body 104. In this example, the third zipper fastener 212 extends along a substantially linear axis between a first end (e.g., a bottom end) and a second end (e.g., a top end).

The backpack 100 comprises a second accessory body 220. The second accessory body 220 may be constructed of a flexible material and positioned within the inner main cavity 200 of the backpack body 104. In an example, the flexible material may include any number of flexible and pliable materials, such as nylon fabric or similar. The material may be treated or otherwise constructed to provide durability, wear resistance, weather/water proof ability, or the like. Although the second accessory body 220 may be constructed primarily of a flexible material, it is to be appreciated that some portions of the second accessory body 220 may be stiffened to provide a certain amount of rigidity and/or form/shape retention. In some examples, some portions of the second accessory body 220 may be constructed to provide other attributes, such as waterproofing.

The second accessory body 220 comprises a first portion 226 and a second portion 228. The first portion 226 of the second accessory body 220 may border the exterior of the backpack body 104. In the illustrated example, the first portion 226 of the second accessory body 220 may be located at the fourth lateral side 112 of the backpack body 104.

In an example, a fourth zipper fastener 230 may be located on the first portion 226 of the second accessory body 220. The fourth zipper fastener 230 is actuatable between an opened position and a closed position. The fourth zipper fastener 230 may be constructed and attached to the first portion 226 of the second accessory body 220 such that when the fourth zipper fastener 230 is in the opened position, access is permitted directly from the exterior of the backpack body 104 to a second ancillary cavity (illustrated in FIG. 6) of the accessory body 202. In the closed position, the second ancillary cavity of the second accessory body 220 is substantially not accessible from the exterior of the backpack body 104. In this example, the fourth zipper fastener 230 extends along a non-linear axis between a first end (e.g., a bottom end) and a second end (e.g., a top end).

In an example, the second portion 228 of the second accessory body 220 may border the inner main cavity 200 of the backpack body 104. In the illustrated example, the second portion 228 of the second accessory body 220 may be located within the backpack body 104, while the first portion 226 of the second accessory body 220 may border an exterior of the backpack body 104.

In an example, a fifth zipper fastener 232 may be located on the second portion 228 of the second accessory body 220. The fifth zipper fastener 232 is actuatable between an opened position and a closed position. The fifth zipper fastener 232 may be constructed and attached to the second portion 228 of the second accessory body 220 such that when the fifth zipper fastener 232 is in the opened position, access is permitted directly from the inner main cavity 200 of the backpack body 104 to the second ancillary cavity of the second accessory body 220. In the closed position, the second ancillary cavity of the second accessory body 220 is substantially not accessible from the inner main cavity 200 of the backpack body 104. In this example, the fifth zipper fastener 232 extends along a substantially linear axis between a first end (e.g., a bottom end) and a second end (e.g., a top end).

In the illustrated example, the accessory body and the second accessory body 220 may be spaced a distance apart from each other within the inner main cavity 200 to define a space 240 therebetween. In this example, the space 240 may be bordered on lateral sides by the second portion 208 of the accessory body 202 and the second portion 228 of the second accessory body 220. The space 240 may be bordered on the front and back by the second side 108 and the first side 106 of the backpack body 104.

Figure 4:
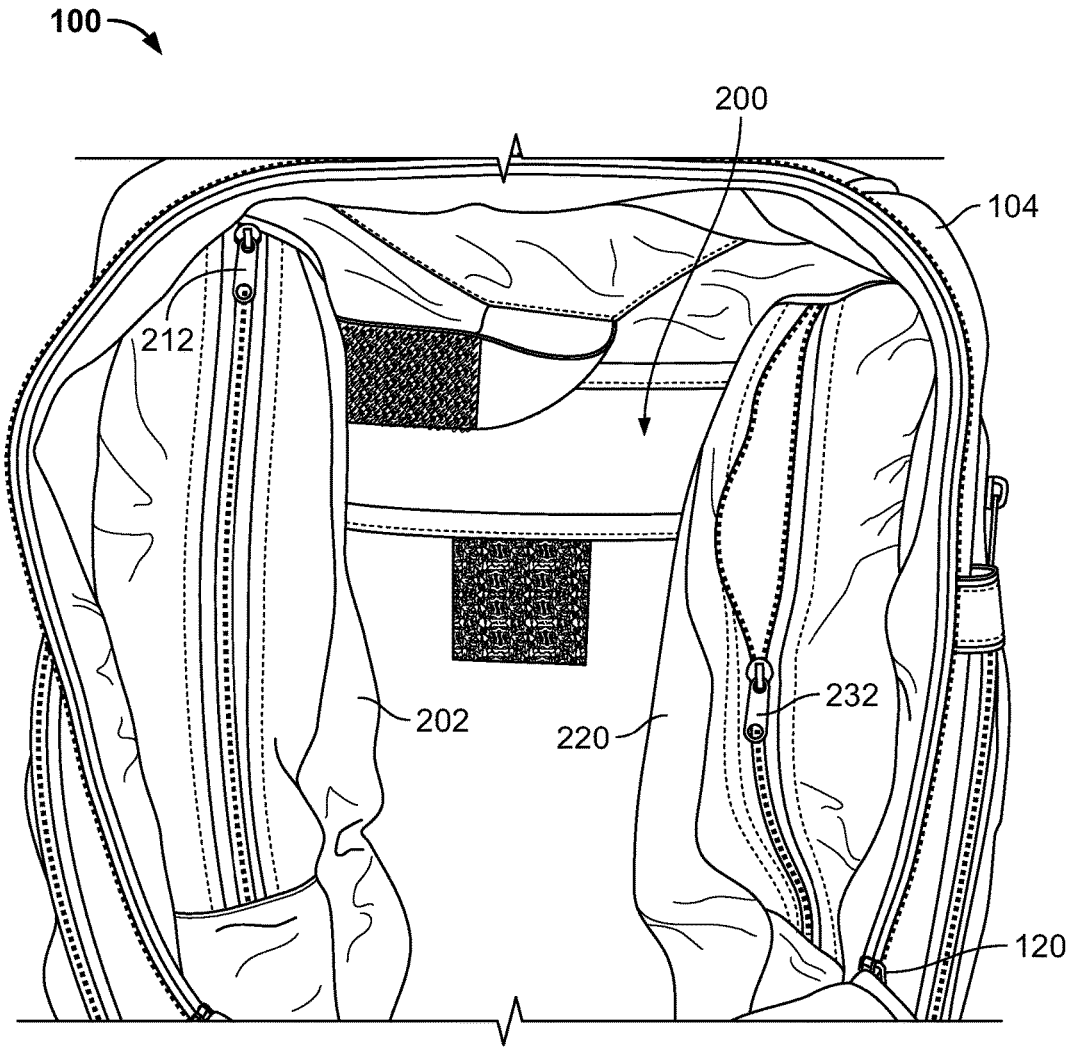
FIG. 4 is a perspective view of the inner main cavity of the backpack in which a fifth zipper fastener is partially opened.

Turning to FIG. 4, the inner main cavity 200 is illustrated. In this example, the third zipper fastener 212 and the fifth zipper fastener 232 are actuatable between the opened position and the closed position. While the third zipper fastener 212 is illustrated in the closed position in this example, the zipper of the third zipper fastener 212 can be pulled downwardly to open the accessory body 202. In this example, the fifth zipper fastener 232 is illustrated in the partially opened position. The zipper of the fifth zipper fastener 232 can be moved upwardly such that the fifth zipper fastener 232 is in the closed position, or downwardly, such that the fifth zipper fastener 232 is in the opened position. As such, the contents of the accessory body 202 and/or the second accessory body 220 can be accessed from the inner main cavity 200 of the backpack body 104 when the first zipper fastener 120 is in the opened position.

Figure 5:
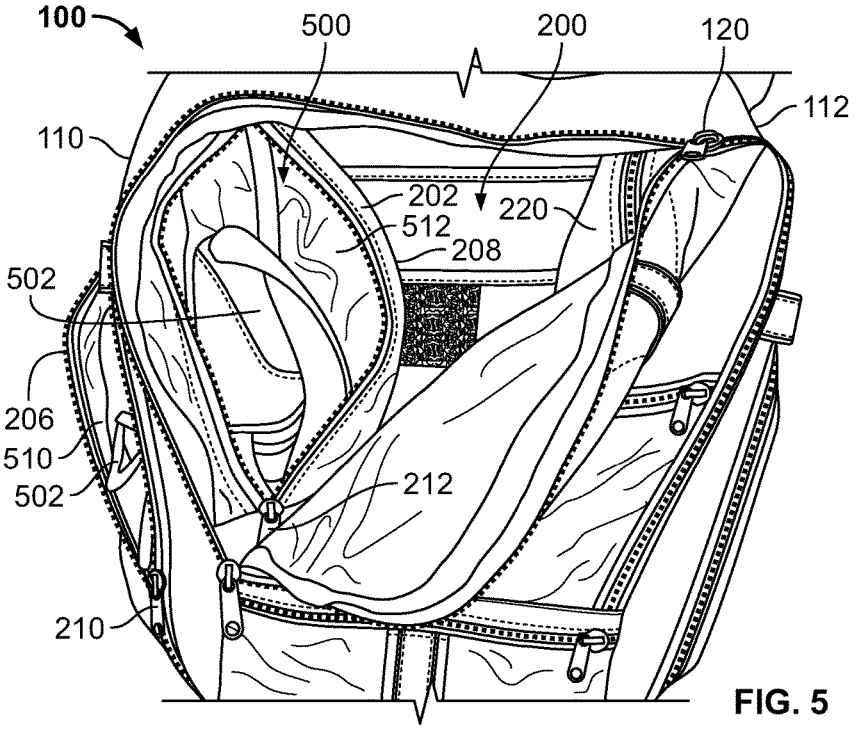
FIG. 5 is a perspective view of the inner main cavity of the backpack in which an ancillary cavity is partially exposed.

Turning to FIG. 5, the first zipper fastener 120 is illustrated as being partially opened such that the accessory body 202 is exposed. In this example, the second zipper fastener 210 and the third zipper fastener 212 of the accessory body 202 may be in the opened position. The accessory body 202 may define an ancillary cavity 500. In this example, when the second zipper fastener 210 is in the opened position, the ancillary cavity 500 is accessible from the exterior of the backpack body 104 through the third lateral side 110. The second zipper fastener 210 can therefore define a first ancillary opening 510. In an example, when the third zipper fastener 212 is in the opened position, the ancillary cavity 500 is accessible from the inner main cavity 200 of the backpack body 104. The third zipper fastener 212 can therefore define a second ancillary opening 512.

An item 502 may be positioned within the ancillary cavity 500 of the accessory body 202. In this example, the item 502 may be accessible through the first portion 206 of the accessory body 202 and through the third lateral side 110 when the second zipper fastener 210 is in the opened position. In addition or in the alternative, the item 502 may be accessible through the second portion 208 of the accessory body 202 from the inner main cavity 200 of the backpack body 104 when the third zipper fastener 212 is in the opened position. As such, when the second zipper fastener 210 and the third zipper fastener 212 are in the opened positions, a pathway is defined from the inner main cavity 200, through the second ancillary opening 512, through the ancillary cavity 500, through the first ancillary opening 510, and to the exterior of the backpack body 104.

In this example, the second accessory body 220 may be in the closed position. In the closed position, the second ancillary cavity of the second accessory body 220 is substantially not accessible from the inner main cavity 200 of the backpack body 104.

Figure 6:
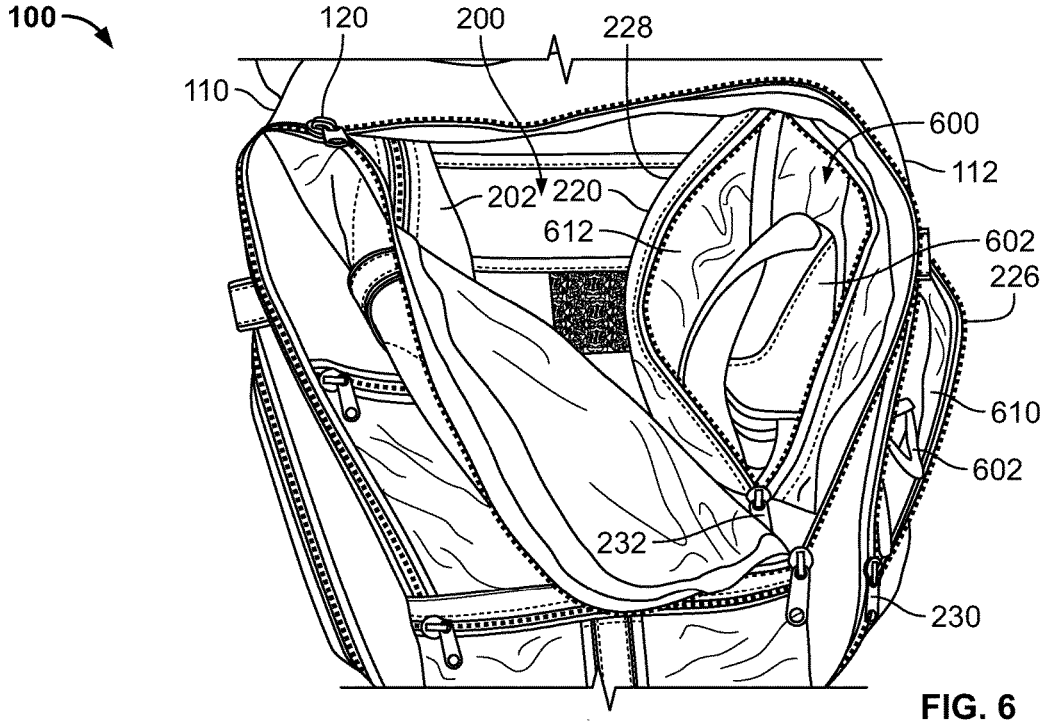
FIG. 6 is a perspective view of the inner main cavity of the backpack win which a second ancillary cavity is partially exposed.

Turning to FIG. 6, the first zipper fastener 120 is illustrated as being partially opened such that the second accessory body 220 is exposed. In this example, the fourth zipper fastener 230 and the fifth zipper fastener 232 of the second accessory body 220 may be in the opened position. The second accessory body 220 may define a second ancillary cavity 600. In this example, when the fourth zipper fastener 230 is in the opened position, the second ancillary cavity 600 is accessible from the exterior of the backpack body 104 through the fourth lateral side 112. The fourth zipper fastener 230 can therefore define a third ancillary opening 610. In an example, when the fifth zipper fastener 232 is in the opened position, the second ancillary cavity 600 is accessible from the inner main cavity 200 of the backpack body 104. The fifth zipper fastener 232 can therefore define a fourth ancillary opening 612.

An item 602 may be positioned within the second ancillary cavity 600 of the second accessory body 220. In this example, the item 602 may be accessible through the first portion 226 of the second accessory body 220 and through the fourth lateral side 112 when the fourth zipper fastener 230 is in the opened position. In addition or in the alternative, the item 602 may be accessible through the second portion 228 of the second accessory body 220 from the inner main cavity 200 of the backpack body 104 when the fifth zipper fastener 232 is in the opened position. As such, when the fourth zipper fastener 230 and the fifth zipper fastener 232 are in the opened positions, a pathway is defined from the inner main cavity 200, through the fourth ancillary opening 612, through the second ancillary cavity 600, through the third ancillary opening 610, and to the exterior of the backpack body 104. In an example, the ancillary cavity 500 and/or the second ancillary cavity 600 can have ancillary volumes (e.g., a first ancillary volume and a second ancillary volume) that are less than a volume of the inner main cavity 200.

Figure 7:
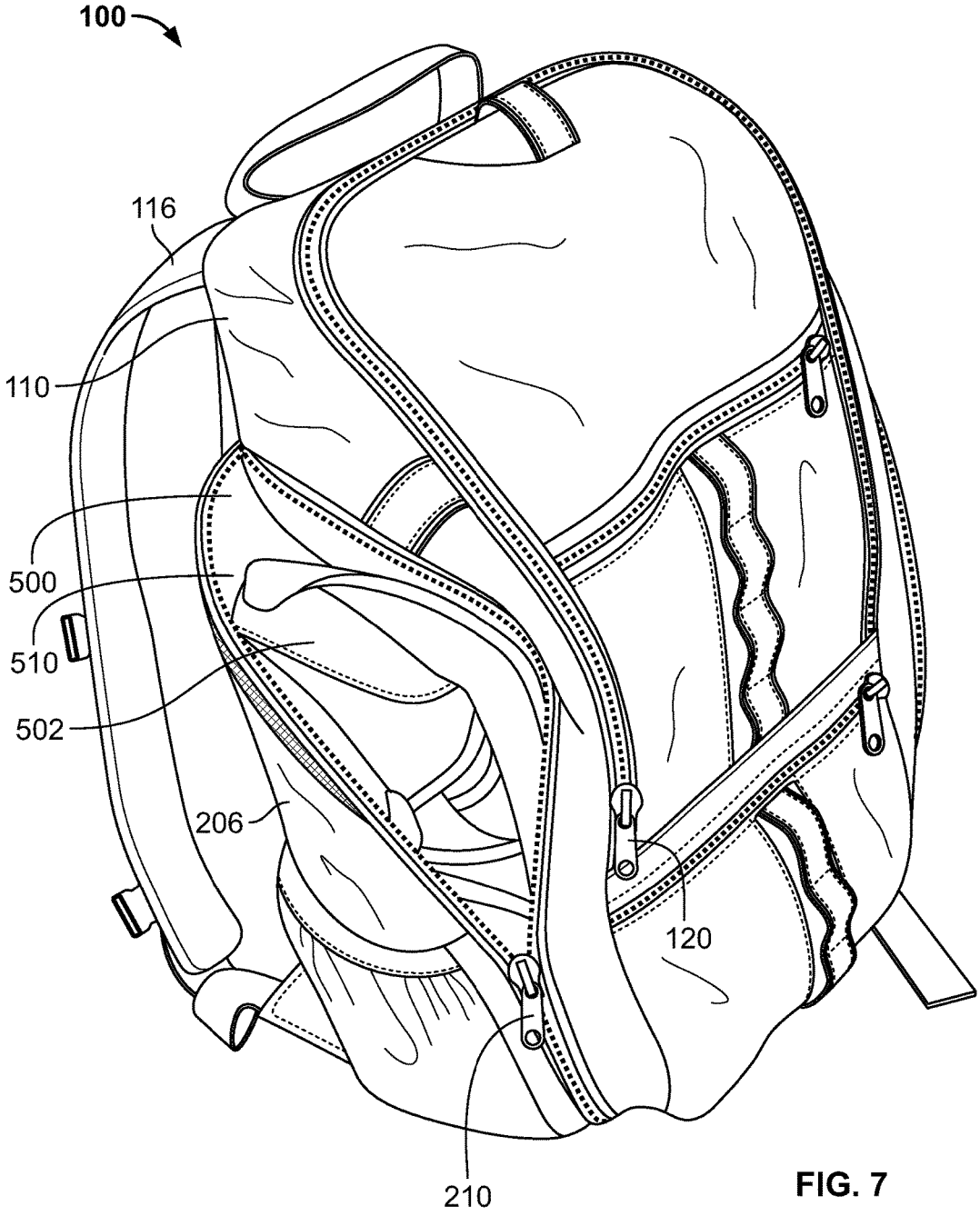
FIG. 7 is a perspective view of the backpack in which the ancillary cavity is partially exposed from the exterior of the backpack.

Turning to FIG. 7, the third lateral side 110 of the backpack body 104 is illustrated. It will be appreciated that while the third lateral side 110 is illustrated, the fourth lateral side 112 of the backpack body 104 may be substantially similar or identical to the third lateral side 110. In this example, the second zipper fastener 210 is in the opened position, such that the item 502 is accessible from the exterior of the backpack body 104.

The backpack 100 may include other features in addition to the ones described above. For example, the backpack 100 may include an attachment to allow for the backpack body 104 to be attached to a structure, such as a bicycle, or the like. In such an example, the attachment may include an opening, aperture, or the like. In one possible example, the attachment may include a hook and loop fastener for attaching the backpack 100 to a bicycle or other transportation vehicle. In another possible example, a panniere clip may be provided in association with the backpack body 104. The panniere clip includes one or more "C" shaped structures that can be used to grip a separate structure, such as one located on the bicycle or other transportation vehicle.

The backpack 100 provides a number of benefits. For example, the specific construction/access configuration of the backpack 100 allows for items that could possibly have different attributes (e.g., wet vs. dry, dirty vs. clean, etc.) to be segregated from other items (e.g., books, papers, laptop computer, etc.). Accordingly, in an example, the user may place items within one or more of the accessory body or the second accessory body and alleviate concerns about such items transferring water/dirt to the other items (e.g., a laptop computer, paper items, books, etc.) that are located within the inner main cavity. This configuration can allow for a user to transport items within the backpack while keeping some of the items segregated. That is, wet/dirty items can be contained within a cavity while dry/clean items can be contained within another cavity. In this way, the wet/dirty items may not contaminate the dry/clean items.

Still further, such a configuration allows a person to quickly and efficiently access items, such as shoes, without opening the first zipper fastener 120 and thus exposing items (e.g., laptop computer, paper items, books, etc.) to exterior adverse weather conditions, viewing by other persons, etc. Such efficiencies of access may be useful for students, commuters, and the like who may not want the items within the inner main cavity to be exposed to weather conditions, thieves, etc. Accordingly, footwear/shoes can be changed in an expedient and safe manner.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first portion and a second portion generally correspond to portion A and portion B or two different or two identical portion or the same portion.

Moreover, "exemplary" may be used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described structures (e.g., elements, resources, etc.), the terms used to describe such structures are intended to correspond, unless otherwise indicated, to any structure which performs the specified function of the described structure (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A backpack for carrying an item by a user, the backpack including:

a backpack body constructed of a flexible material, the backpack body defining an inner main cavity, the inner main cavity defined between a top wall and a bottom wall of the backpack body;

at least one shoulder strap coupled to the backpack body;

a first zipper fastener on the backpack body, the first zipper fastener configured to be actuatable between an opened position and a closed position, wherein in the opened position, the inner main cavity of the backpack body is accessible from an exterior of the backpack body, wherein in the closed position, the inner main cavity of the backpack body is not accessible from the exterior of the backpack body;

an accessory body constructed of a flexible material and positioned within the inner main cavity of the backpack body, the accessory body defining an ancillary cavity, a first portion of the accessory body bordering the exterior of the backpack body, a second portion of the accessory body bordering the inner main cavity of the backpack body, wherein an axis intersecting the top wall and the bottom wall of the backpack body intersects the ancillary cavity of the accessory body;

a second zipper fastener on the first portion of the accessory body, the second zipper fastener actuatable between an opened position and a closed position, wherein in the opened position, the ancillary cavity of the accessory body is accessible from the exterior of the backpack body through a first ancillary opening defined by the second zipper fastener, a first location of the first ancillary opening spaced a first minimum distance from the top wall, a second location of the first ancillary opening spaced a second minimum distance from the bottom wall, wherein in the closed position, the ancillary cavity of the accessory body is not accessible from the exterior of the backpack body; and a third zipper fastener on the second portion of the accessory body, the third zipper fastener actuatable between an opened position and a closed position, wherein in the opened position, the ancillary cavity of the accessory body is accessible from the inner main cavity of the backpack body through a second ancillary opening defined by the third zipper fastener, a third location of the second ancillary opening spaced a third minimum distance from the top wall, a fourth location of the second ancillary opening spaced a fourth minimum distance from the bottom wall, wherein in the closed position, the ancillary cavity of the accessory body is not accessible from the inner main cavity of the backpack body;

wherein:

the third location is in closer proximity to the top wall than the first location such that the third minimum distance is less than the first minimum distance; and the second location is in closer proximity to the bottom wall than the fourth location such that the second minimum distance is less than the fourth minimum distance.

2. The backpack of claim 1, wherein when the second zipper fastener and the third zipper fastener are in the opened positions, a pathway is defined from the inner main cavity, through the ancillary cavity, and to the exterior of the backpack body.

3. The backpack of claim 1, wherein the second zipper fastener extends along a non-linear axis between a first end and a second end.

4. The backpack of claim 1, wherein the third zipper fastener extends along a linear axis between a first end and a second end.

5. The backpack of claim 1, wherein the first zipper fastener extends in a inverted U-shaped configuration.

6. The backpack of claim 1, wherein the first portion of the accessory body borders a lateral side of the backpack body.

7. The backpack of claim 1, wherein the ancillary cavity of the accessory body has a volume that is less than a volume of the inner main cavity.

* * * * *